United States Patent [19]

Bailey

[11] 4,150,445

[45] Apr. 24, 1979

[54] SHOWER BATH CHAIR FOR USE IN CONJUNCTION WITH A BATH TUB

[76] Inventor: Bernard B. Bailey, 1247 Pharmacy Ave., Scarborough, Canada

[21] Appl. No.: 797,259

[22] Filed: May 16, 1977

[51] Int. Cl.[2] ..... A47K 3/12

[52] U.S. Cl. ..... 4/185 S; 4/185 L; 4/185 R; 4/145

[58] Field of Search ..... 4/185 S, 185 L, 185 R, 4/145, 146, 6, 7, 134, 177

[56] References Cited

U.S. PATENT DOCUMENTS

| | | | |
|---|---|---|---|
| 3,040,335 | 6/1962 | Gellmann | 4/185 S X |
| 3,090,969 | 5/1963 | Maling | 4/145 |
| 3,121,235 | 2/1964 | Gellmann | 4/185 S X |
| 3,169,253 | 2/1965 | Segar | 4/145 |
| 3,377,630 | 4/1968 | Robare | 4/6 |
| 3,703,733 | 11/1972 | McLoughlin | 4/185 L |
| 3,832,740 | 9/1974 | McClarrin | 4/145 |
| 3,900,902 | 8/1975 | Jarosinski | 4/6 X |
| 3,902,200 | 9/1975 | Pratt | 4/6 |
| 3,947,898 | 4/1976 | Ducharme | 4/6 |

FOREIGN PATENT DOCUMENTS

| | | | |
|---|---|---|---|
| 711836 | 6/1965 | Canada | 4/185 L |
| 869210 | 4/1971 | Canada | 4/185 L |

*Primary Examiner*—Henry K. Artis
*Attorney, Agent, or Firm*—Kenneth M. Garrett

[57] ABSTRACT

A shower assembly which can be used in conjunction with normal household bathing facilities while minimizing the disruption for normal use of the facility. The assembly includes a track to support the chair above the bath, and suspension means for the chair which permits linear movement along the track and rotary movement whereby the chair can face outwardly when being engaged and exited by user. The chair seat is dished to trap water therein to cleanse the seated areas of the user, and a fresh water supply is arranged directly into the seat area to rinse the seated areas.

18 Claims, 6 Drawing Figures

FIG. 3
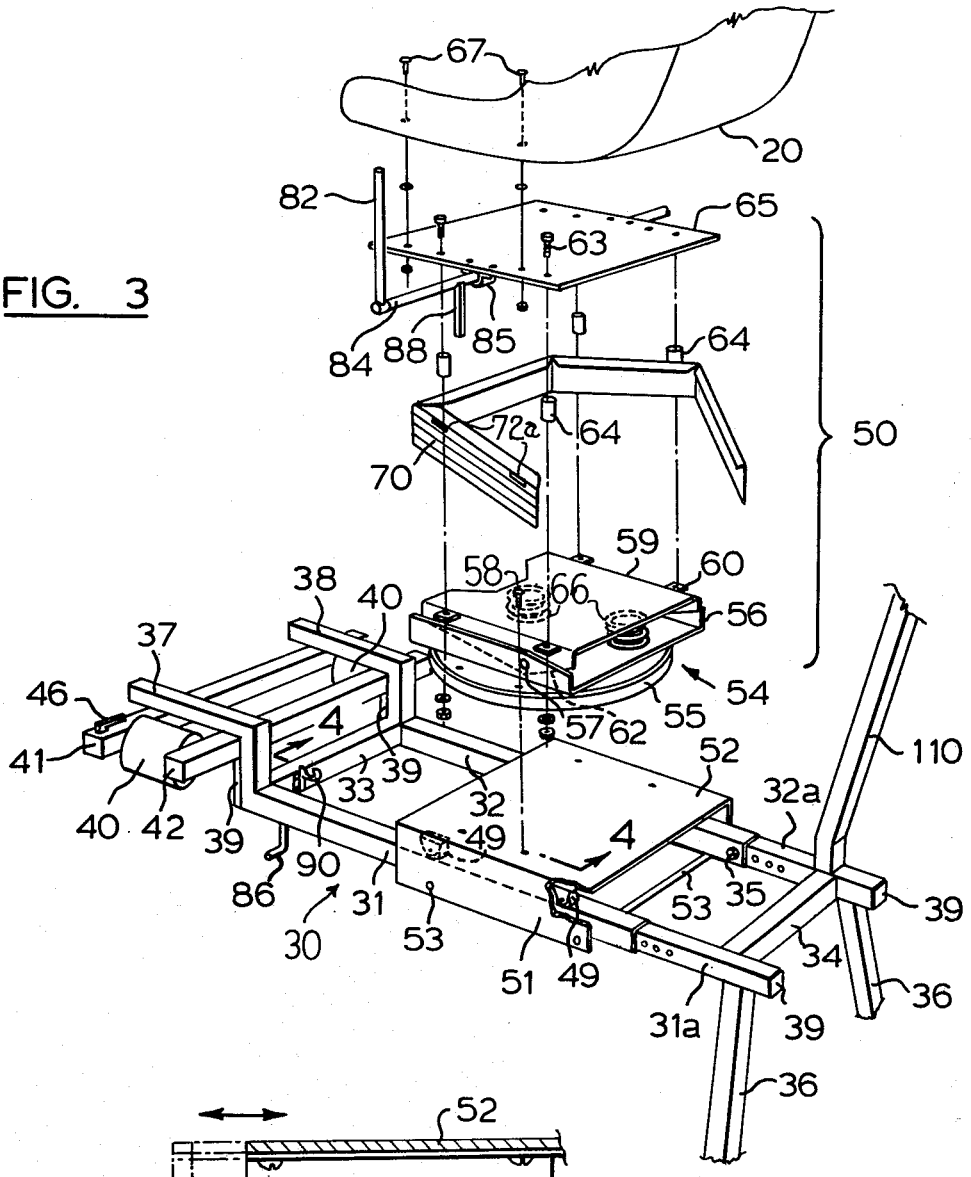
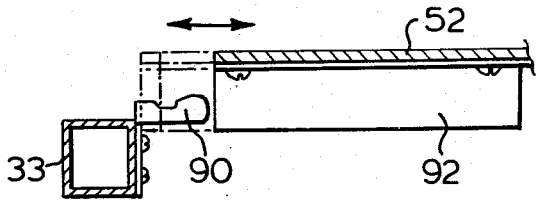
FIG. 4

SHOWER BATH CHAIR FOR USE IN CONJUNCTION WITH A BATH TUB

This invention concerns improvements in showering and washing facilities for infirm persons. It particularly relates to problems posed in the conversion of normal household bathing facilities for such purpose whilst at the same time causing a minimum dislocation of such facility for normal users.

Certain of the prior art shows conversions of a permanent nature whereby the entrance of an infirm user into the confines of a bath tub are facilitated. Such conversions necessitate major structural change to the bathing facility and or the surrounding wall or floor area, and are unacceptable for the present purposes due both to the relatively high initial cost, and also to the loss or restriction of the facility for normal use by non-infirm users. Where, as in U.S. Pat. No. 2,648,849 issued Aug. 18, 1953 to Webb et al., a relatively easily demountable track means upon which a chair may ride is mounted transversely above the bath tub, the means of entry to the chair is such as to necessitate the track extending well beyond the wall of the bath, thus forming an unnecessary encumbrance in a small bath room.

In U.S. Pat. No. 3,040,335, issued June 26, 1962 to Gellmann, a shower chair is shown which includes a static chair frame placed in the bath tub, and spray outlets mounted on the frame for douching desired areas of the body. The seat of such chair provides for a relatively small area of body contact, whereby sprays directed from under the seat can cleanse the ano-genital areas of the body. Whilst such cleansing is highly desirable, the seat support offered is deemed to be insufficient, particularly where the seat moves on a track suspended above the bath as in Webb et al., supra. Furthermore the provision of a seat having a large opening therein to permit the upward flow of water is somewhat limitative such that the chair would be unsuitable for use by children.

It is a primary object of the present invention to provide in a shower chair of the type including track means for traversing the side of the bath tub, improvements in the mounting arrangement of the chair so as to permit a compact assembly.

It is a further object of the present invention to provide in a shower chair assembly of the above type a chair giving good body support whilst at the same time permitting a reasonable cleansing action of the seated areas of the body of a user.

It is a still further object of the present invention to provide in a shower chair assembly of the above type simple means for restraining movement of the chair about at least two orthogonal axes to permit safe entry and exit from the chair.

It is yet another object of my invention to provide automatically engaging means for restraining movement of the chair.

It is a still further object of my invention to provide a shower chair assembly that is co-operable with the structure of a bath tub whereby the chair assembly may be readily moved into and out of position according to whether it is desired to employ the bathing facility with or without the shower chair.

In its broadest aspect, my invention comprises providing, in a chair mounted for travel along a track, a vertical pivot means so that the chair can pivot about vertical axis. The chair is entered or exited when facing outwardly, and then swung through 90° to align with the longitudinal axis of the bath, following which the chair may be moved along the track until centrally located above the bath.

In a more specific aspect my invention comprises providing a chair having an inwardly dished seat portion constructed of generally impermeable material so as to provide good body contact. The dished seat forms a reservoir to collect soapy water which drains from the upper part of the body during the douche and which assists in cleansing the seated portions of the body including the ano-genital areas. A hose connectible to water supply has an outlet directing clean water directly into the dished seat. Towards the end of the douche water is diverted to the seat area through the seat outlet so as to flush the reservoir free of accumulated soapy water and rinse and further cleanse the seated areas of the body.

In a further aspect, my invention comprises providing a simple means whereby the chair may be restrained from movement. In a preferred aspect of the invention, a restraining means is mounted on the chair and positionable so as to engage the side of the bath when the chair is outwardly facing adjacent the outer end of the track. The engagement restrains the chair from moving along the track and from pivoting about its vertical pivot mounting. In a still further aspect of my invention, the restraining means is automatically engaged by movement of the chair along its track.

Still further objects and advantages of my invention will be apparent from the following description, taken in conjunction with the accompanying drawings wherein:

FIG. 3 shows the chair support assembly of FIG. 1 partially broken away and exploded to reveal the chair mounting means, the track and the track mounting means in greater detail;

FIG. 4 shows in elevation detail of a second locking means for the chair, taken along line 4—4 of FIG. 3;

Figures 1, 2:
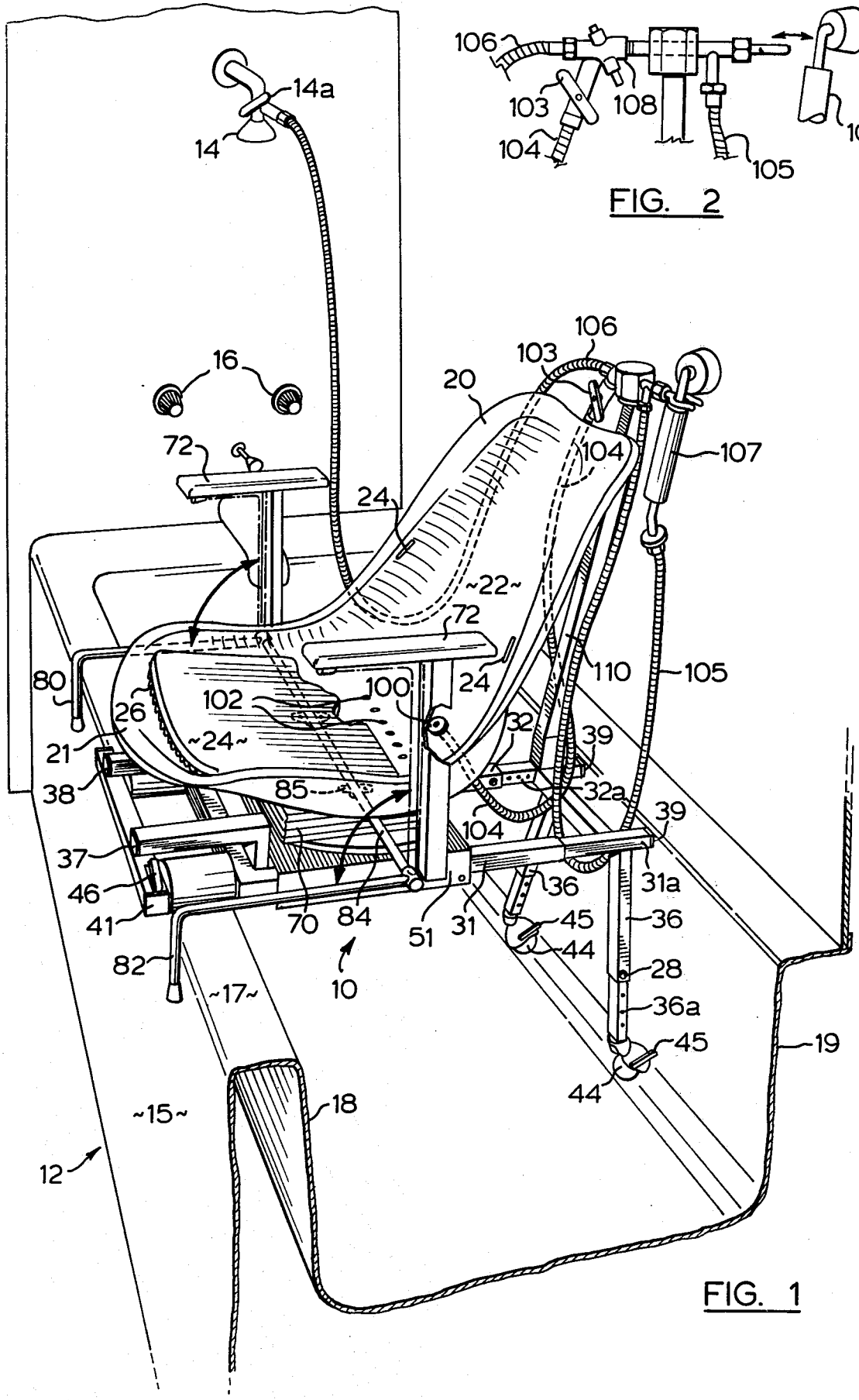
FIG. 1 shows in isometric view a shower chair assembly positioned above a bath tub, the chair being rotated so as to be outwardly facing, and locking means for the chair.
FIG. 2 shows detail of a water diverter arrangement for use with the shower chair of FIG. 1.

Referring to FIG. 1 and 3 a shower chair assembly constructed in accordance with my invention is indicated generally by the numeral 10, and is shown positioned for use in conjunction with a domestic bathing and showering facility including a bath tub 12, fixed shower head 14 and water control taps 16. Shower chair assembly 10 comprises a chair body 20, a track shown generally as 30 from which said chair body is supported by a chair support shown generally as 50. Track 30 comprises a pair of parallel tubes 31, 32 rigidly spaced apart at their forward end by a spreader 33. At the rearward end a second pair of parallel tubes **31*a*, 32*a* rigidly spaced apart by a spreader 34 are telescopically received in tubes 31, 32 respectively so as to permit an adjustment in the overall length of track 30 of up to about 15cm. Sheet metal screws 35 pass respectively through inwardly facing portions of tubes 31, 31*a* and 32, 32*a* so as to retain the track as a rigid rectangular form. Track 30 is mounted above the bath tub 12** by legs 36 which depend from the track adjacent the rearward end thereof. At the forward end of track 30 a pair of L shaped support brackets 37, 38 are connected, the horizontal arms of each of the brackets being generally some 5–8cms ( 2–3 inches ) above the level of track 30. When track 30 is placed in position over bath tub 12, the horizontal arms of brackets 37, 38 overlay the longitudinal lip 17 of bath tub 12, and the vertical arms of the brackets are closely adjacent the inner wall 18 of the tub so as to provide a stop to limit outward movement of track 30. Movement of track 30 in the opposite direction is limited by adjusting the length of track 30, using the telescoping adjustment previously described, so that the ends of telescoping tube members 31*a*, 32*a* are proximate the inner wall 19 of tub 12. Glides 39 of nylon or similar material are provided on the outer facing surfaces of the vertical arm of each support bracket 37, 38 and the ends of tubes 31*a*, 32*a*.

If desired the horizontal arm of each bracket support 37, 38 may bear directly upon the lip 17 of bath tub 12. However it is preferred to provide means for easily moving the chair assembly 10 longitudinally with respect to bath tub 10. Such means comprises a pair of rubber rollers 40 rotatably mounted between roller support members 41, 42. Members 41, 42 depend from the horizontal arms of brackets 37, 38 and are transverse thereto. Legs 36 are suitably terminated with wheels 44; these are preferably of a spherical type which are presently obtainable as articles of commerce, so as to provide a reasonable contact area with the curved portion of tub 12 adjacent the root of wall 19 with the floor of the tub.

It is desirable to provide means for braking upon at least one of the rollers 40 or the wheels 44. Lever 46 mounted on roller support 41 comprises a proprietary clutch mechanism to apply a frictional resistance to the bearing of roller 40.

Legs 36 are desirably provided with a means for adjusting their length so as to support track 30 horizontally over tub 12. As shown in FIGS. 1 and 3, such means may comprise a simple telescoping action between upper portion 36 and lower portions 36*a* of the legs. Of course, it will be apparent that where it is desired to provide a shower chair assembly 10 to be used in conjunction with a standard size of bath tub, no adjustment for either track width or track height need be provided.

The chair support 50 is best seen in FIG. 3 and comprises a platform 52 having rollers 49 attached thereto which bear upon the upwardly facing surface of tubes 31, 32 to permit platform 52 to travel lengthwise along track 30. Lateral movement of platform 52 is limited by side skirts 51 which are folded downwardly from platform 52, and upward movement of the platform is constrained by rods 53 which pass beneath track 30 and secure to skirts 51. To the upper side of platform 52 is secured a proprietary mechanism 54 which comprises a ball bearing turntable 55, permitting rotation about a vertical pivot when oriented as illustrated, and a rocker 56 permitting a constrained rocking movement about a horizontal axis 57. The lower member of the turntable 55 is secured to platform 52 by screws 58, and the upper member 59 of the rocker 56 is in turn secured via lugs 60 to a chair support plate 65 by screws 63 and spacer washers 64. A rubber apron 70 generally surrounds mechanism 54 to protect the mechanism from the ingress of deleterious matter that may be encountered in use. Apron 70 is slotted at 72*a* to permit lugs 60 to pass through the wall thereof, thereby providing an easy method of attachment.

In its most simple form the chair body 20 of my shower assembly may be simply a seat 21 which is secured to chair support plate 65 by screws 67. Desirably chair body 20 will also comprise a back support 22. In use, the shower chair assembly will be placed in a bath tub 12 with track 30 arranged to be generally horizontal, and the chair body 20 pulled forwardly on track 30 and pivoted on turntable 55 to be outwardly facing. When a user is seated in chair 20, the chair will be pivoted on turntable 55 about 90°. In order to assist the passage of user's legs over the lip 17 of bath tub 12, the weight of the user is applied to rock the chair 20 backwards on rocker mechanism 56 so as to elevate the legs. Some assistance may be necessary where the user has little or no control of leg movement however.

It will be apparent that some form of locking the chair 20 against lengthwise movement along track 30 is required so as to stabilize the chair when being engaged or disengaged by a user. A preferred form of locking mechanism is shown in FIG. 1, which comprises a pair of hook members 80, 82 positioned on either side of chair 20 and connected to a bar 84 passing beneath seat 21 and rotatably connected to chair support plate 65 by journals 85. Hooks 80, 82 are proportioned so that when chair 20 is positioned adjacent the forward end of track 30, the hooks engage the outer sidewall 15 and lip 17 of the tub 12. By this simple expedient movement of the chair 20 about 2 orthogonal axes is restricted, i.e., movement along track 30 and also rotary movement about turntable 55. The hooks 80, 82 also act to restrain longitudinal movement on rollers 40 and wheels 44 of the chair assembly as a whole and the brakes actuated by levers 45 and 46 may be dispensed with if desired. Hooks 80, 82 are disengaged by an upward rotary movement and stored in a generally vertical position shown in broken outline in FIG. 1 beneath arm rests 72, which rigidly secure to chair support plate 65 on each side of chair 20. Hooks 80, 82 may be lowered manually to engage the lip 17 of bath tub 12. A preferred arrangement is shown in FIG. 3, however, wherein a trip lever 86 is secured to the under side of tubular member 31, to project outwardly. A trip arm 88 depends from bar 84, and as chair 20 moves towards the forward end of track 30, arm 88 engages lever 86 to cause bar 84 to rotate, thereby lowering hooks 80, 82 into engaging relationship with the lip 17 of bath tub 12. I do not consider it to be necessary to lock chair 20 in a manner to prevent rocking of the chair about horizontal axis 57 when a user is entering or exiting the chair. Rocker 56 has only a limited movement, being restricted by cammed surface 62 and springs 66. However hooks 80, 82 may be adapted to restrict rocking movement of the chair 20 should this be desired.

Chair body 20 is suitably formed from a thermoplastic material such as a styrene of an acrylate polymer for example. In the second aspect of my invention the seat 21 of chair 20 is inwardly dished and generally impermeable so as to permit the accumulation of water therein. In the normal course of using the shower chair assembly 10 for showering, soapy water will drain from the upper portions of the user's body into the dished seat, and assist in cleansing the ano-genital areas of the body. In order to rinse the soapy water from the dished seat I provide a water supply which discharges directly into the general area of the seat through a fan spray outlet 100. The water supply to the spray outlet 100 may be through a hose 104 connected to any convenient water supply means. Desirably a drainage outlet is provided in seat 21. In the extreme this may be a single opening which is stoppered with a removable plug, or with other restrictive means so as to vary the rate of water escape from seat 21. A simple but effective arrangement is to provide a series of small holes 102 of about 4mm ( 1/6 inch ) diameter so as to permit the water to drain from the seat at a rate generally less than at which it will flow into the seat area, either by direct discharge or by drainage from the body of a user. In the preferred structure, chair seat 21 will slope generally towards back support 22 and both the drainage holes 102 and the spray outlet will locate at the back of the seat adjacent the root of the back support. Chair 20 may be further provided with a cushion 24 of an elastomeric foam material if desired, the cushion having drainage channels 24 provided in the under surface thereof. Chair 20 may further be desirably provided with a belt restraining means, particularly where there is some danger of the user falling therefrom. For this purpose I prefer to provide slot openings 24 on each side of back support 22 for the attachment of a belt.

Figure 5:
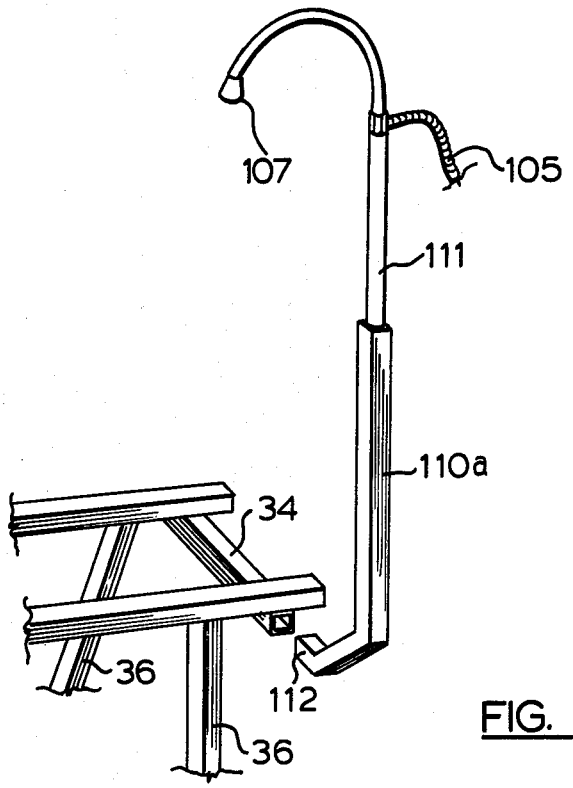
FIG. 5 shows a mounting arrangement for supporting a shower head forming a part of a preferred assembly.

Whilst the shower chair assembly 10 of my invention may be used in conjunction with the fixed shower head 14 of a normally installed showering and bathing facility, it is preferred to provide a "built in " showering facility in the assembly. As best seen in FIGS. 1 and 2, a water supply hose 106 connects to a diverter valve 108 whereby water may be selectively diverted to hose 104, which connects to spray outlet 100, or hose 105, which connects to a "telephone" shower head 107 forming part of the shower chair assembly. The rate of water supply to spray outlet 100 may be controlled by control valve 103. Diverter valve 108 and telephone shower head 107 are supported on upright 110, in turn supported from framework forming track 30. In the embodiment shown in FIG. 5, tubular spreader 34 is open at each end thereof, and upright **110*a* is adapted at its lower end 112 to telescopically connect into the spreader to be supported therefrom. The chair assembly shower head 107 can therefore be positioned at either side of the track 30 so as to make the chair assembly 10 essentially left handed or right handed as desired. Also in the embodiment of FIG. 5, show head 107 is supported upon a second upright 111 which telescopes into upright 110*a***, whereby the shower head may be easily adjusted both for height and position relative to a user.

Whilst water supply hose 106 can be connected to any convenient water outlet, it is readily connected to the shower head 14 through a diverter valve **14*a* identical to that earlier shown as 108. To convert the showering facility from a "normal" use to use in conjunction with shower chair 10, vice-versa, it is only required to roll the shower chair assembly into or out of position, and arrange diverter valve 14*a***to provide the required water flow.

Figure 6:
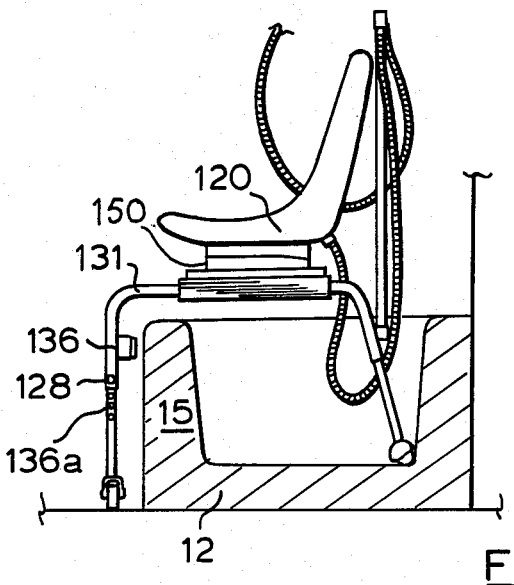
FIG. 6 is an elevational view showing a second embodiment of the invention.

In the foregoing a particular and preferred embodiment of a track and track support means have been illustrated and described, but my invention is not to be limited thereto. Thus each end of track 30 may be supported by L shaped members such as 37, 38 which bear upon the opposed lips of bath tub 12 either directly, where it is not desired that the track be moveable along the bath, or through rollers such as 40. Alternatively each end of track 30 may be supported by legs such as 36 which bear upon the bottom wall of bath tub 12. A still further arrangement is shown in FIG. 6; here a track member 131 comparable to track member 31 of the earlier embodiment extends continuously beyond the outward side 15 of bath 12, and is supported at the outward facing end by an upper leg member 136 having a floor engaging lower leg member **136*a* telescopically adjustable therein, the leg members being locked by screw 128. The shower chair assembly of this embodiment further comprises a chair body 120 and chair support 150 movable along track member 131 and a similar track member spaced therefrom, but not visible in this illustration. It will be appreciated that the track, and hence the seat of chair 120 of this embodiment may conveniently be supported at a greater height above bath tub 12 than the track and seat of the previously described embodiment. The greater height of the chair seat may be preferred in permitting a more free movement of the legs of a user over the lip of bath tub 12 when entering or exiting the bath tub. Under these circumstances the chair support 150** may dispense with the rocking action earlier described.

Whilst one feature of my invention comprises a novel hook means which may automatically be tripped to engage the side of the bath so as to restrain chair 20 from moving along track 30, other means is contemplated. Thus, as shown in FIG. 4, a proprietary mechanism sold under the trade mark "Touch Latch" comprises a hook member 90 and a catch member 92. Hook member 90 is fixed to spreader bar 33 and catch 92 to the underside of platform 52 of chair support 50. As chair support 50 moves towards the end of track 30, catch 92 engages hook 90, restraining rearward travel of chair support 50. Hook 90 and catch 92 will only disengage when chair support 50 is moved forwardly by about 3–4mm; this forward movement of the chair support will usually result only from a conscious effort, as the normal force experienced by the chair support will be one tending to move the support rearwardly on track 30. It will be apparent that many other modifications of my shower chair assembly 10 may be made according to particular circumstances. The scope of my invention is therefore to be considered according to the spirit of the claims appended hereto.

I claim:

1. A shower chair assembly for use in combination with a bath tub comprising a chair means;

a track means transversely supportable over said bath tub;

means for supporting said track means over said bath tub;

chair support means moveable lengthwise on said track means for supporting said chair on said track means;

said support means including vertical pivot means whereby said chair can rotate about a generally vertical axis locking means for locking said chair adjacent at least one end of said track means to restrain said lengthwise movement;

and means for restraining said rotational movement.

2. The shower chair of claim 1 wherein said rotational restraining means and said locking means are provided by hook means connected to said chair means and adapted to engage a longitudinal edge of said bath tub.

3. The shower chair of claim 2 wherein trip means is provided adjacent the outward end of said track means, said trip means being adapted to engage a trip lever to move said hook means towards a position to engage a side edge of said bath tub.

4. The shower chair of claim 1 wherein said track support means includes roller means whereby said track may be moved longitudinally with respect with said bath tub.

5. The shower chair of claim 4 wherein said roller means is adapted to engage to horizontal lip of said bath tub.

6. The shower chair of claim 5 wherein said track support means includes L shaped brackets, one arm of each said bracket being adapted to overlay the longitudinal lip of said bath tub, the other arm being downwardly directed connecting to said track means below said lip means to provide means limiting transverse movement of said track means.

7. The shower chair of claim 1 wherein chair support means includes horizontal pivot means permitting a constrained reclining movement of said chair.

8. The shower chair of claim 1 wherein said track support means includes leg means supporting said track means adjacent at least one end thereof, said leg means terminating at the foot portion thereof in wheel means.

9. The shower chair of claim 8 wherein said leg means is telescopically adjustable for height.

10. The shower chair of claim 9 wherein said leg means is adapted to contact an interior wall of said bath tub.

11. The shower chair of claim 1 wherein said track support means includes leg means supporting said track means adjacent each end thereof.

12. A shower chair assembly as defined in claim 1 wherein said chair means includes an inwardly dished seat of generally impermeable material to permit the accumulation of water therein; hose means connectible to water supply, an outlet for said hose means connected to said chair means to discharge directly into said seat area, whereby posterior portions of a user may be irrigated and rinsed with fresh water.

13. In a shower chair assembly for use in combination with a domestic bathing or showering facility, said assembly including a track means, means for supporting said track means in proximity to said facility, chair means mounted on said track means for movement into and out said facility, the improvement wherein said chair means includes an inwardly dished seat of generally impermeable material to permit the accumulation of water therein, hose means connectable to a water supply, an outlet for said hose means connected to said chair means to discharge directly into said seat area whereby ano-genital areas of a user may be irrigated and rinsed with fresh water; drainage means in said seat, said drainage means being adapted to drain water from said seat at a rate generally less than that at which water is discharged into the seat area.

14. The shower chair of claim 13 wherein said water outlet is provided at the rear of said seat.

15. The shower chair of claim 13 including shower head means supported from said chair above the level of said seat and connected to said hose means, diverter valve means interposed in said hose means between said shower head means and said outlet to said seat to selectively direct water through said shower head or said outlet.

16. The shower chair of claim 15 wherein said shower head is supported upon an upright bar member, said bar member being detachably mountable upon a frame means supporting said seat.

17. The shower chair of claim 16 wherein said frame means includes a plurality of spaced apart mounting means for mounting said bar member.

18. The shower chair of claim 17 wherein said bar is telescopically adjustable.

* * * * *